US008309500B2

(12) United States Patent
Beatty et al.

(10) Patent No.: US 8,309,500 B2
(45) Date of Patent: Nov. 13, 2012

(54) FOOD GRADE LUBRICANT COMPOSITIONS

(75) Inventors: Daryl L. Beatty, Lake Jackson, TX (US); Martin R. Greaves, Pearland, TX (US)

(73) Assignee: Dow Global Technologies LLC, Midland, MI (US)

( * ) Notice: Subject to any disclaimer, the term of this patent is extended or adjusted under 35 U.S.C. 154(b) by 855 days.

(21) Appl. No.: 11/631,549

(22) PCT Filed: Jul. 13, 2005

(86) PCT No.: PCT/US2005/024825

§ 371 (c)(1), (2), (4) Date: Jan. 4, 2007

(87) PCT Pub. No.: WO2006/019800

PCT Pub. Date: Feb. 23, 2006

(65) Prior Publication Data

US 2008/0312113 A1 Dec. 18, 2008

(51) Int. Cl.
*C10M 107/34* (2006.01)
*C10M 145/34* (2006.01)

(52) U.S. Cl. ..... 508/579; 508/280; 508/435; 508/577

(58) Field of Classification Search ..... 508/100, 508/162, 110, 577

See application file for complete search history.

(56) References Cited

U.S. PATENT DOCUMENTS

| | | | | |
|---|---|---|---|---|
| 2,425,755 | A | 8/1947 | Roberts et al. | |
| 2,425,845 | A | 8/1947 | Toussaint et al. | |
| 4,062,785 | A | 12/1977 | Nibert | |
| 5,538,654 | A | 7/1996 | Lawate et al. | |
| 6,087,308 | A | 7/2000 | Butler et al. | |
| 6,288,012 | B1 * | 9/2001 | Li et al. | 508/113 |
| 6,576,298 | B2 * | 6/2003 | Bennett et al. | 427/424 |
| 2002/0115573 | A1 | 8/2002 | Hei et al. | |
| 2003/0176302 | A1 * | 9/2003 | Li et al. | 508/532 |
| 2004/0102334 | A1 * | 5/2004 | Li et al. | 508/180 |

FOREIGN PATENT DOCUMENTS

| | | | |
|---|---|---|---|
| JP | 63 142098 A | | 6/1968 |
| JP | 62121793 A | | 6/1987 |
| JP | 63142098 | * | 6/1988 |
| PL | 149256 | | 1/1990 |
| PL | 154393 | | 8/1991 |

OTHER PUBLICATIONS

George B. Kelly, Jr. and George W. Buttrick, Tappi (1970), 53(10), pp. 1900-1904.

Anonymous: Title 21—"Food and Drugs", Online! Nov. 2003, U.S. Government Printing Office, GPO Web Site, XP002351805 Retrieved from the Internet: URL:http//www.cfsan.fda.gov/{1rd/FCF178.html cited in the application 21 C.F.R. 178 Table of contents p. 348, 21 C.F.R. 178-3570 List of food grade lubricants pp.404-405, 21 C.F.R. 178.3750: Polyehtylene glycol MW 200-9500 p. 421.

* cited by examiner

*Primary Examiner* — Ellen McAvoy
*Assistant Examiner* — Ming Cheung Po

(57) ABSTRACT

Novel non-aqueous water soluble food grade lubricant compositions comprising: (a) About 5% to about 50% of a polyalkylene glycol comprised of an ethylene oxide/propylene oxide copolymer, or polymer of propylene oxide, having molecular weight greater than 1,500; and (b) About 50% to about 95% of a polyethylene glycol having molecular weight of from about 200 to about 600; wherein said lubricating compositions have viscosities of about 28 to about 100% at 40° C. The novel non-aqueous water soluble food grade lubricant compositions are particularly useful in food processing and packaging equipment applications where low viscosity food grade lubricants with low pour points are desired, and in applications where there is a need for equipment and spill cleanup. These food grade lubricant compositions are also environmentally friendly due to their water solubility, rapid biodegradability, and low aquatic toxicity.

17 Claims, No Drawings

FOOD GRADE LUBRICANT COMPOSITIONS

BACKGROUND OF THE INVENTION

The present invention relates to lubricant compositions and, more specifically, to polyalkylene glycol based anhydrous food grade lubricant compositions. The food grade lubricant compositions of the present invention are particularly useful as hydraulic oils, gear oils, and compressor oils for equipment used in the food processing and packaging industry.

The food grade lubricants are considered to be "indirect food additives" used in equipment in food processing and packaging plants where the lubricant compositions may accidentally get in contact with the food being processed. Food grade lubricants are specially blended compositions comprising base fluids and functional additives in the past cleared by the U.S. Food and Drug Administration (FDA) and approved by U.S. Department of Agriculture (USDA) as H-1 lubricants. The H-1 lubricants were regulated in 21 C.F.R. §178 (at 178.3570), 21 C.F.R. §1.72 and 21 C.F.R. §1.82. Today, the lubricant manufacturers and food and beverage processors are themselves responsible to use only lubricants that are generally recognized as safe for use in equipment used for producing, manufacturing, packing, processing, preparing, treating, transporting or holding food since the FDA and USDA are no longer responsible for the assessment and registration of food grade lubricants.

In addition to meeting the food safety requirements, the food grade lubricant compositions must also be effective lubricants. They should lubricate food processing and packaging equipment parts, resist viscosity change, resist oxidation, protect against rust and corrosion, and provide wear protection. The lubricating compositions should also perform effectively under various lubrication conditions ranging from hydrodynamic thick film conditions to boundary thin film conditions.

In general, the food grade lubricant compositions are formulated from at least one base fluid and at least one food grade functional additive employed for its known use. The base fluid can be either a mineral oil or a blend of mineral oils, or a synthetic fluid. Medicinal white oil, corn oil, palm oil, and cottonseed oil are some of the mineral oils that are known to be suitable for use in food grade lubricants. Polyalphaolefins (PAO), polyalkylene glycols (PAG), and polyethylene glycols (PEG) are synthetic fluids that are known to be suitable for use in food grade lubricants. The synthetic fluids offer superior oil life, load carrying and anti-wear performance and perform well at high and low temperatures. Various known functional additives that are generally recognized as safe for use in food grade lubricants may be added to the base fluid for their known uses.

Polyalkylene glycols (PAG's) are widely used in the lubricants industry as a base fluid or as an additive in compositions. The predominant chemistries used are random copolymers of ethylene oxide (EO) and propylene oxide (PO), and also homo-polymers of propylene oxide.

The 21 C.F.R. §178.3570 regulation allows for polyalkylene glycols (PAG's) of medium and high viscosity to be used for food grade lubricant applications. That is, PAG's having molecular weight greater than 1500 can be used. PAG's with molecular weights greater than 1500 are not useful for lubricant applications requiring low viscosity. The viscosity of a neat EO/PO copolymer of 1500 molecular weight is about 130 cSt at 40° C. The viscosity of a PO monol is typically 120 cSt at 40° C. Both of these are well above the required range of 32 cSt to 100 cSt for many lubricant applications. Low molecular weight PAG's (those having molecular weight less that 1500) cannot be used since they are not recognized by the 21 C.F.R. §178.3570 regulation as being safe for use for food grade lubricant applications. The three specific classes of H-1 acceptable PAG's described in 21 C.F.R. §178.3570 are:

1. [alpha]-Hydro-omega-hydroxypoly(oxyethylene)poly (oxypropylene) produced by random condensation of mixtures of ethylene oxide and propylene oxide containing 25 to 75 percent by weight of ethylene oxide; minimum molecular weight 1,500; (Chemical Abstracts Service Registry No. 9003-11-6.) The minimum viscosity attainable with this type of fluid at 1500 molecular weight is about 130 cSt at 40° C.

Commercial examples of this type of fluid are: Synalox™ 40-D150, or UCON™ 68-H-1400, both available from The Dow Chemical Company.

2. [alpha]-Butyl-omega-hydroxypoly(oxyethylene)poly (oxypropylene) produced by random condensation of a 1:1 mixture by weight of ethylene oxide and propylene oxide with butanol; minimum molecular weight 1,500; (Chemical Abstracts Service Registry No. 9038-95-3.) The minimum viscosity attainable with this type of fluid at 1500 molecular weight is about 125 cSt at 40° C.

A commercial example of this is: UCON 50-HB-660.

3. [alpha]-Butyl-omega hydroxy-poly(oxypropylene); minimum molecular weight 1,500; (Chemical Abstracts Service Registry No. 9003-13-8.) The minimum viscosity attainable with this type of fluid at 1500 molecular weight is about 120 cSt at 40° C.

A commercial example of this is: UCON LB-625.

Low viscosity food grade lubricants can be formulated using polyethylene glycols (PEG's). However, PEG's have a major disadvantage in that they have high pour points. A specific shortcoming of this type of product is the relatively high pour point, (about −9° C.), which can lead to solidification in equipment when the equipment is shut down at low ambient temperatures. When this occurs, the equipment cannot be restarted until the fluid is heated externally. This prevents the use of 100% PEG's as a base fluid for formulating lubricants for many applications. Although PEG's are not listed on the 21 C.F.R. §178.3570 regulation, they are generally recognized as safe for use in food and are listed on 21 C.F.R. 178.3910 regulation.

Various types of synthetic food grade lubricants have been described in the literature and used commercially. Examples include water based food grade lubricants containing polyalkylene glycols (PAG's) having molecular weight greater than 1500, polyethylene glycols (PEG's), or polyalphaolefins (PAO) and various additives.

U.S. Patent Application Publication No. US 2002/0115573 A1 (Hei et al) discloses a food grade aqueous lubricating oil for use in conveyor processing of foods (that is, for lubricating the interface between the surface of a can or bottle food container and the moving conveyor). The lubricants typically comprise edible oil and can also contain a variety of other functional additives. The lubricant can also contain an $(EO)_x(PO)_y(EO)_z$ surfactant block copolymer where EO represents ethylene oxide residue, PO represents a propylene oxide residue, and each x, y and z is an integer of about 2 to about 100.

George B. Kelly and George W. Buttrick, *Tappi* (1970), 53(10), pp. 1900-1904 disclose that polyethylene glycols, methyl ether of polyethylene glycols and random copolymers of ethylene oxide and propylene oxide are each effective lubricants for paper coatings containing starch and starch-latex binder system.

Polish Patent Nos. 149,256 and 154,393 disclose a fire resistant hydraulic-lubricating fluid comprising diethylene glycol or propylene glycol, an ethylene oxide/propylene oxide polymer, and a major portion of water.

Japanese Patent No. JP 62/121,793 (Daiichi Kogyo Seiyaku Co., Ltd.) discloses a heat-resistant water-based hydraulic fluid containing (a) water, (b) glycerin-ethylene oxide-propylene oxide copolymer (MW=40,000; propylene oxide=60 wt %), and (c) propylene glycol-ethylene oxide-propylene oxide copolymer (MW=600; ethylene oxide=50 wt %).

U.S. Pat. No. 6,087,308 (Butler et al) discloses a food grade lubricating oil which contains a major amount of a food grade natural or synthetic base oil in combination with a minor amounts of food grade additives including a thickener, an antioxidant, a rust inhibitor, an anti-wear additive, an anti-foam, and a coupling agent. Synthetic base oils disclosed are food grade polyalphaolefins.

U.S. Pat. No. 5,538,654 (Lawate et al) discloses a food grade lubricant comprising (a) a major amount of a genetically modified vegetable oil or synthetic triglyceride oil, and (b) a minor amount of a performance additive.

U.S. Pat. No. 4,062,785 (Nibert) discloses a non-aqueous food grade lubricant comprising a major amount of a mineral oil and a minor amount of a fatty amide.

New non-aqueous food grade lubricant compositions have now been discovered. These new food grade compositions overcome the disadvantages of the known food grade lubricants. It has now been discovered that the blend of PAG's and PEG's surprisingly provide a lubricant compositions with good lubricity, low viscosity and a pour point of about −22° C., which gives a greatly increased margin of protection. In addition, good biodegradability and low aquatic toxicity of these new food grade lubricant compositions makes them very attractive for use in machinery for food processing and packaging applications where environmental friendliness is important. These new non-aqueous food grade lubricant compositions are water soluble and as such they can be used in any application requiring a water soluble machine lubricant.

SUMMARY OF THE INVENTION

In one aspect the present invention concerns a non-aqueous water soluble food grade lubricant composition comprising:

(a) a polyalkylene glycol having molecular weight greater than 1,500, preferably from about 1500 to about 20,000 more preferably from about 1500 to about 4000;

(b) a polyethylene glycol having molecular weight of from about 200 to about 600, preferably from about 200 to about 400, most preferably from about 200 to about 300; and, optionally, (c) at least one functional food grade additive;

and wherein said lubricant compositions have a viscosity of from about 28 to about 100, preferably from about 32 to about 100, most preferably from about 32 to about 68, cSt at 40° C., In another aspect, the present invention concerns a method of lubricating surfaces of the machinery used for processing or packaging food, food packaging materials, or other materials related to the food processing industry, which method comprises the step of applying to the surfaces of the food processing or packaging machinery non-aqueous water soluble food grade lubricant compositions comprising:

(a) a polyalkylene glycol, which is a monol or diol, copolymer of both EO and PO having molecular weight greater than 1,500, preferably from about 1500 to about 20000; more preferably from about 1500 to about 4000;

(b) a polyethylene glycol having molecular weight of from about 200 to about 600, preferably from about 200 to about 400, most preferably from about 200 to about 300; and, optionally, (c) at least one functional food grade additive;

and wherein said lubricant compositions have a final blended viscosity of about 28 to about 100, preferably from about 32 to about 100, most preferably from about 32 to about 68, cSt at 40° C.

DETAILED DESCRIPTION OF THE INVENTION

The non-aqueous water soluble food grade lubricant compositions of the present invention exhibit low viscosities and surprisingly have low pour points. Moreover, due to their water solubility, relatively low toxicity, and good biodegradability they are particularly suitable for use in applications where environmental friendliness is important. The fact that the lubricant compositions of the present invention are non-aqueous means that these fluids are resistant to the performance problems associated with water-containing food grade lubricant compositions such as corrosion, wear and high temperature limitations. Since they are water soluble, the lubricant compositions can also be used in any application requiring a water soluble machine lubricant.

The non-aqueous water soluble food grade lubricant compositions of the present invention are conveniently formulated by blending in at least one copolymer polyalkylene glycol, which may be either a monol or diol, having a molecular weight greater than 1,500, preferably from about 1500 to about 20000, more preferably from about 1500 to about 4000, and at least one polyethylene glycol having molecular weight of from about 200 to about 600, preferably from about 200 to about 400, more preferably from about 200 to about 300. The non-aqueous water soluble food grade lubricant compositions of the present invention have viscosities of about 28 to about 100, preferably from about 32 to about 100, most preferably from about 32 to about 68, cSt at 40° C.

If desired, at least one functional food grade additive that is listed as an H-1 additive in 21 C.F.R. §178 (at 178.3570) by USDA or is generally recognized as safe for use in food grade lubricants can also be blended in the non-aqueous food grade lubricant compositions of the present invention.

The blending of the components of the non-aqueous food grade lubricant compositions of the present invention is done in conventional blending equipment and in the manner known to a person of an ordinary skill in the art.

The polyalkylene glycols (PAG's) having molecular weight greater than 1,500, component (a), useful in the practice of the present invention are well known in the art and many methods of preparing these compounds are available and used in the art. Examples of useful PAG's include, but are not limited to, butanol initiated ethylene oxide/propylene oxide(EO/PO) random copolymers having the EO/PO ratio of about 1:1, such as Synalox 50-100B, a butanol initiated EO/PO random copolymer having molecular weight of 1700, and Ucon 50-HB-660, a butanol initiated EO/PO random copolymer having molecular weight of 1700; diol initiated EO/PO random copolymers having EO content of from about 25 to about 75 percent by weight, such as, for example, Synalox 40-D100, a diol initiated random EO/PO copolymer having molecular weight of 1700, and Synalox 40-D150, a diol initiated random EO/PO copolymer having molecular weight of 1900; Propylene oxide (PO) homopolymers, although approved by 21 C.F.R. §178.3570 were found to not be useful in the present invention. The Synalox products are available from The Dow Chemical Company and the Ucon products are available from Union Carbide Corporation. Typically, the polyalkylene glycol copolymer is used in an amount of from about 5 to about 50, preferably from about 10 to about 40, most preferably from about 15 to about 30, percent by weight, based on the total weight of the lubricant composition.

The polyethylene glycols (PEG's) having molecular weight of from about 200 to about 600, component (b), useful in the practice of the present invention are well known in the art and many methods of preparing these compounds are available and used in the art. Examples of useful PEG's include, but are not limited to, Carbowax™ Sentry™200, a polyethylene glycol having molecular weight of 200; Carbowax Sentry 300, a polyethylene glycol having molecular weight of 300; and Carbowax Sentry 400, a polyethylene glycol having molecular weight of 400; each available from Dow Chemical Company. Typically, polyethylene glycol is used in an amount of from about 50 to about 95, preferably from about 60 to about 90, most preferably from about 70 to about 85, percent by weight, based on the total weight of the lubricant composition.

Various functional food grade additives useful for use in food grade lubricating compositions that are listed as H-1 additives in 21 C.F.R. §178 (at 178.3570) by USDA or as HX-1, HT-1 or H-1 by NSF International, or are generally recognized as safe for use in food grade lubricants may also be formulated into the non-aqueous water soluble food grade lubricant compositions of the present invention. Such known additives include, but are not limited to, food grade lubricity additives (such as boundary agents, anti-wear agents and extreme pressure agents), food grade corrosion inhibitors, food grade metal passivators, food grade antioxidants, and food grade anti-foaming agents.

Each of the aforementioned additives is used in an amount typical for use of such additive in lubricants or hydraulic fluids. This amount will vary with the additive used and a person of an ordinary skill in the art would know which additive and what amount of the additive to use depending on the application for which the anhydrous lubricant or hydraulic fluid compositions of the present invention are used.

When used, the food grade lubricity and anti-wear additives are typically used in an amount of from about 0 to about 0.6, percent by weight based on the total weight of the non-aqueous water soluble food grade lubricant composition.

Examples of anti-wear additives include, but are not limited to, various oil soluble sulfur and/or phosphorous containing materials and fatty acids and their ester, amine and other derivatives which are known to reduce friction. Thus, sulfur and/or phosphorous containing materials such as triphenyl phosphothionate, alkylphenyl phosphoric acid esters and their amine derivatives, zinc di(alkyl dithiophosphate), zinc di(thiocarbamate) and methylene bis(dithiocarbamate) are useful as anti-wear additives. An example of an antiwear additive which is already approved for use in H-1 fluids is di(n-octyl)phosphite (CAS Reg. No. 1809-14-9).

Examples of lubricity additives include, but are not limited to, fatty acids, and other mono- and dicarboxylic acids, and their amides and amine salts; dithiophosphates, organic amine/phosphate blends (such as Irgalube 349, sold by Ciba Specialty Chemicals Corporation), organo-molybdenum compounds; phosphorothionates; alkylated phosphate esters; triphenyl phosphates; alkylated triphenyl phosphates; and fatty amines (such as Amine-O and Sarkosyl-O, sold by Ciba Specialty Chemicals Corporation).

When used, the corrosion inhibitors are typically used in an amount of from about 0 to about 0.5, percent by weight based on the total weight of the non-aqueous food grade lubricant composition. Food grade corrosion inhibitors include various ionic and non-ionic surface active agents.

Examples of ionic corrosion inhibitors include phosphoric acid, mono- and di-hexyl esters, compounds with tetramethyl nonyl amines and $C_{10}$ to $C_{18}$ alkyl amines, and also $C_1$ to $C_{10}$ alkylated phosphates and phosphites. Examples of ionic corrosion inhibitors include, but are not limited to, phosphoric acid, mono- and di-hexyl esters, compounds with tetramethyl nonyl amines and $C_{10}$ to $C_{18}$ alkyl amines, and also $C_1$ to $C_{10}$ alkylated phosphates and phosphites. Irgalube 349, an amine phosphate corrosion inhibitor (available from Ciba Specialty Chemicals), is a typical ionic corrosion inhibitor approved for food grade lubricants.

Examples of non-ionic corrosion inhibitors include food grade fatty acids and their esters. Thus, esters of sorbitan, glycerol, other polyhydric alcohols or polyalkylene glycols may be used. Food grade esters from fatty alcohols alkoxylated with alkylene oxides, or sorbitan alkoxylated with alkylene oxides, or sorbitan ester alkoxylated with alkylene oxides are additional useful examples. Various derivatives of succinic acid or succinic anhydride, formed by reaction with fatty acids and or amines, are also useful corrosion inhibitors. Non-limiting examples of these materials include sorbitan mono-oleate, ethoxylated vegetable oil, ethoxylated fatty acids, ethoxylated fatty alcohols, fatty glyceride esters, polyoxy ethylene sorbitan mono-oleate, polyoxyethylene sorbitan, glycerol mono oleate, glycerol di oleate, glycerol mono stearate, glycerol di stearate. Span 80 (sorbitan mono-oleate) is a typical non-ionic corrosion inhibitor approved for food grade lubricants.

When used, the metal passivators are typically used in an amount of from about 0 to about 0.1, percent by weight based on the total weight of the non-aqueous food grade lubricant compositions of the present invention. Examples of metal passivators include, but are not limited to, various indoles, pyrazoles, imidazoles, thiazoles, triazoles, benzotriazoles, thiadiazoles, dithiophosphates, and dithiocarbamates. Non-limiting examples of these additives include N,N-bis(2-ethylhexyl)-ar-methyl-1H-benzotriazole-1-methaneamine, N,N-dialkyl derivatives of N-methylamino triazoles and benzotriazoles, 2-mercaptobenzothiazole, 2,5-dimercapto-1,3,4-thiadiazole derivatives, and N,N'-disalicylidene-1,2-propanediamine. Irgamet 39, a copper passivator, (available from Ciba Specialty Chemicals), is a typical non-ionic corrosion inhibitor approved for food grade lubricants.

When used, the antioxidants are typically used in an amount of from about 0 to about 0.6, percent by weight based on the total weight of the non-aqueous food grade lubricant composition. Examples of the antioxidants include, but are not limited to, disodium decanedioate, hexamethylenebis(3,5-ditert-butyl-4-hydroxyhydrocinnamate), phenyl-α-naphthylamine, N-phenylbenzenamine, reaction products of tert-alkyl and primary amines with mono- and diisoctyl esters of phosphoric acid, phenothiazine, propyl gallate, 2,6-di-tert-butyl-4-methylphenol (or butylated hydroxytoluene (BHT), vitamin E, hindered phenolic antioxidants (such as Irgalube L-64, available from Ciba Specialty Chemicals), amine containing antioxidants, and phosphites.

Non-aqueous water soluble food grade lubricant compositions of the present invention can also be used in non food processing and packaging industrial and commercial applications where low viscosity lubricants with low pour points and good biodegradability or low aquatic toxicity would be advantageous to use.

Non-aqueous water soluble food grade lubricant compositions of the present invention not only exhibit unexpected low viscosity and pour point properties, but they also exhibit good biodegradability and low aquatic toxicity.

All parts, percentages and ratios herein are by weight unless otherwise indicated.

The invention will be further clarified by a consideration of the following examples which are intended to be purely exemplary of the present invention.

The following components are employed in the examples.

Carbowax Sentry 300 is a polyethylene glycol having molecular weight of 300, available from The Dow Chemical Company;

Synalox 40-D100 is a diol initiated random EO/PO copolymer having molecular weight of 1,700, an EO content of 60% and a PO content of 40%, available from The Dow Chemical Company;

Synalox 40-D150 is a diol initiated random EO/PO copolymer having molecular weight of 1900, an EO content of 60% and a PO content of 40%, available from The Dow Chemical Company;

Irgalube L64 is an antioxidant which is a mixture of aminic and high molecular weight phenolic anti-oxidants, available from Ciba Specialty Chemicals;

Irgalube 349 is a corrosion inhibitor which is a liquid mixture of amine phosphates, available from Ciba Specialty Chemicals;

Irgamet 39 is a liquid metal passivator which is a tolyltriazole derivative, available from Ciba Specialty Chemicals;

Irganox L57 is an aminic antioxidant available from Ciba Specialty Chemicals;

PANA is phenyl-alpha-napthtylamine, available from Bayer Crop Science; and

Sarkosyl O is N-oleyl sarcosine available from Ciba Specialty Chemicals.

EXAMPLE 1 TO EXAMPLE 5 AND COMPARATIVE EXAMPLE CE1

The non-aqueous water soluble lubricant compositions were formulated by blending the components in a glass beaker with a mechanical stirring device. Blending speed and time were not critical, as the components were readily miscible. The order of addition of the components was not important. The components and the weight percentage of each component in the formulated non-aqueous water soluble lubricant compositions are given in Table 1 below.

TABLE 1

Low temperature performance of blends

| Composition | Example 1 | Example 2 | Example 3 | Example 4 | Example 5 | Comparative CE 1 |
|---|---|---|---|---|---|---|
| Carbowax Sentry 300, wt. % | 95 | 90 | 85 | 75 | 50 | 100 |
| Synalox 40-D150, wt. % | 5 | 10 | 15 | 25 | 50 | 0 |
| Physical Properties: | | | | | | |
| Freeze point, ° C. | −26 | −27 | −31 | −30 | −35 | −10 |
| Pour Point, ° C. | −19 | −19 | −22 | −22 | −26 | −10 |
| Viscosity, cSt at 40° C. | 37.2 | 42.0 | 47.2 | 59.1 | 97.7 | 32.8 |
| Viscosity, cSt at 100° C. | 6.5 | 7.3 | 8.1 | 10.1 | 16.6 | 5.8 |

*Comparative example CE 1 is not an example of the present invention.

As can be seen from the data provided in Table 1, each of the compositions of Examples 1 to 5 exhibit unexpectedly lower pour and freeze points than the Carbowax Sentry 300 alone, which is the fluid represented in Comparative Example CE1.

TABLE 2

Viscosity of lubricant blends of the present invention.

| PEG Component | | PAG Component Synalox | | Viscosity Profile | | | | Invention or |
|---|---|---|---|---|---|---|---|---|
| PEG 200 or 300 | Weight Percent | 40-D100 or 40-D150 or other | Weight Percent | Viscosity cSt @ 100° C. | Viscosity cSt @ 40° C. | Viscosity cSt @ −17.8° C. | Viscosity Index (VI) | Comparative Example |
| PEG 300 | 100 | None | 0 | 5.77 | 32.8 | Solid | 118 | C.E 1 |
| PEG 300 | 90 | D100 | 10 | 6.87 | 39.5 | 1700 | 133 | Inv. |
| PEG 300 | 90 | D150 | 10 | 7.26 | 42.0 | 1800 | 137 | Inv. |
| PEG 300 | 85 | D100 | 15 | 7.49 | 43.2 | 1800 | 140 | Inv. |
| PEG 300 | 81 | D100 | 19 | 8.01 | 46.3 | 1860 | 145 | Inv. |
| PEG 300 | 85 | D150 | 15 | 8.11 | 47.2 | 1920 | 145 | Inv. |
| PEG 300 | 70 | D150 | 30 | 11.2 | 65.7 | 2350 | 163 | Inv. |
| PEG 300 | 50 | D150 | 50 | 16.6 | 97.7 | 2950 | 184 | Inv. |

TABLE 2-continued

Viscosity of lubricant blends of the present invention.

| PEG Component | | PAG Component Synalox | | Viscosity Profile | | | | Invention or |
|---|---|---|---|---|---|---|---|---|
| PEG 200 or 300 | Weight Percent | 40-D100 or 40-D150 or other | Weight Percent | Viscosity cSt @ 100° C. | Viscosity cSt @ 40° C. | Viscosity cSt @ −17.8° C. | Viscosity Index (VI) | Comparative Example |
| PEG 300 | 25 | D150 | 75 | 26.0 | 151 | 3750 | 209 | C.E. 2 |
| PEG 300 | 90 | UCON 50 HB-660 | 10 | 6.92 | 39.3 | 1620 | 136 | Inv. |
| PEG 300 | 80 | UCON 50 HB-660 | 20 | 8.22 | 46.5 | 1710 | 152 | Inv. |
| PEG 200 | 95 | D100 | 5 | 4.90 | 24.5 | 810 | 126 | Inv. |
| PEG 200 | 90 | D100 | 10 | 5.60 | 28.3 | 920 | 139 | Inv. |
| PEG 300 | 90 | UCON LB-625 | 10 | | Not Miscible | | | C.E 3 |
| PEG 300 | 50 | UCON LB-625 | 50 | | Not Miscible | | | C.E 4 |
| PEG 300 | 25 | UCON LB-625 | 75 | | Not Miscible | | | C.E 5 |

*UCON LB-625 is a butanol initiated polymer of propylene oxide.

The examples above demonstrate that either of the two approved types of PAG copolymers are useful when blended with PEG in the present invention. Further, the blends in Table 2 demonstrate that useful H-1 lubricant blends in any viscosity from about 28 cSt to about 100 cSt at 40° C. can readily be made with either of the two types of approved copolymers.

The comparative examples in tables 1 and 2 further define the scope of the invention by illustrating blends that were found to not be useful in the present invention.

Comparative example C.E.1—Polyethylene Glycol 300 (PEG 300) without a PAG component is deficient because the freezing point of this product is about −10° C. This results in solidification in the equipment when used in food processing areas related to frozen foods.

Comparative example C.E.2—The blend of much less than 50% PEG 300 with a PAG of over 1500 MW, in this case a 25%/75% blend results in a viscosity in excess of the desired range of ISO 32-100, limiting the useful range of the invention.

Comparative example C.E.3—The blend of PEG-300 with a butanol initiated propylene oxide polymer, such as UCON LB-625 in a ratio of 90% PEG with 10% PAG is not miscible, and does not form a homogeneous mixture useful in this invention.

Comparative example C.E.4—The blend of PEG 300 with a butanol initiated propylene oxide polymer, such as UCON LB-625 in a ratio of 50% PEG with 50% PAG is not miscible, and does not form a homogeneous mixture useful in this invention.

Comparative example C.E.5—The blend of PEG 300 with a butanol initiated propylene oxide polymer, such as UCON LB-625 in a ratio of 25% PEG with 75% PAG is not miscible, and does not form a homogeneous mixture useful in this invention. Because the third type of PAG which is approved for H-1 applications, butanol initiated homopolymers of propylene oxide, did not form homogenous blends with PEG fluids, they are not useful in the present invention.

EXAMPLE 6 TO EXAMPLE 11

The non-aqueous water soluble lubricant compositions were formulated by blending first the base stock components Carbowax Sentry 300 and Synalox 40-D 150 in a glass beaker with a mechanical stirring device and then adding various additives to the blend at 60° C. with stirring for one hour. The order of addition of the additives was not important. The components, the additives and the weight percentage of each component and additive in the formulated non-aqueous water soluble lubricant compositions are given in Table 3 below.

TABLE 3

| Composition (Wt. %) | Example 6 | Example 7 | Example 8 | Example 9 | Example 10 | Example 11 |
|---|---|---|---|---|---|---|
| Carbowax Sentry 300, | 79.0 | 79.4 | 79.1 | 79.5 | 78.3 | 78.3 |
| Synalox 40-D100, | 19.8 | 19.9 | 19.8 | 19.9 | 19.5 | 19.6 |
| PANA | | | | | 1.0 | 1.0 |
| Irgalube L64 | 0.6 | 0.6 | | | 0.6 | |
| Irganox L57 | | | 0.5 | 0.5 | | 0.5 |
| Irgalube 349 | 0.5 | | 0.5 | | 0.5 | 0.5 |
| Irgamet 39 | 0.1 | 0.1 | 0.1 | 0.1 | 0.1 | 0.1 |
| Results after: 500 hours: | | | | | | |
| pH | 7.4 | 7.7 | 5.0 | 8.8 | 4.8 | 4.6 |
| TAN, mg KOH/g | 0.2 | 0.13 | 0.44 | 0.15 | 0.57 | 0.62 |
| Results after: 1000 hours: | | | | | | |
| pH | 6.2 | 7.8 | 5.4 | 8.6 | 5.3 | 4.5 |
| TAN mg KOH/g | 0.31 | 0.17 | 0.49 | 0.42 | 0.52 | 0.60 |
| Results after: 1770 hours: | | | | | | |
| pH | 5.8 | 6.5 | 5.3 | 7.1 | 5.2 | 4.6 |
| TAN mg KOH/g | 0.51 | 0.37 | 0.84 | 0.98 | 0.82 | 0.96 |

TABLE 3-continued

| Composition (Wt. %) | Example 6 | Example 7 | Example 8 | Example 9 | Example 10 | Example 11 |
|---|---|---|---|---|---|---|
| Results after: 2780 hours: | | | | | | |
| pH | 6.2 | 6.5 | 5.1 | 7.0 | 5.4 | 4.7 |
| TAN mg KOH/g | 0.34 | 0.33 | 3.37 | 0.77 | 2.28 | 1.06 |
| Results after 3780 hours: | | | | | | |
| pH | 6.0 | 6.5 | | 6.8 | | |
| TAN mg KOH/g | 0.45 | 0.48 | | 0.99 | | |

TAN is the Total Acid Number of the lubricant, measured in units of mg KOH/g
Typical new fluid (0 hours) above pH 8.0 and TAN 0.10.

As can be seen from pH and Total Acid Number (TAN) data given in Table 3 above, each of the compositions of Examples 6 to Example 11 is still acceptable for use after 1770 hours in a static air oxidation test at 120° C. The static air oxidation test is performed by inserting 1 inch square coupons of copper, aluminum, and steel into a 100 ml beaker. Each beaker is filled with 90 grams of the selected fluid and the beakers are placed in a forced air oven at 120° C. for the duration of the test. Aliquots of sample are removed periodically for determination of pH and TAN, to verify satisfactory fluid condition. Acceptable lubricant compositions are determined by measurement of pH greater than 4.5 and TAN less than 1.0 mgKOH/g. Table 3 clearly demonstrates that each of the compositions of Examples 6 to 11 meets these requirements.

The tribological performance of the compositions of the present invention was also tested in comparison to industry standard rotary screw compressor lubricants. In this test, SSR Ultra Coolant™, available from Ingersoll-Rand and Sullube™, available from Sullair Corporation were compared to two formulations of the present invention. In Table 4, dynamic coefficient of friction was measured over a period of one hour, using an Optimol Schwingung Reibung Verschleiss (SRV) apparatus. This test is conducted using a ball oscillating on a plate, at 100N loading at 60° C. and 200N loading at 20° C., with a frequency of 50 Hz, a stroke length of 1 mm, and a test duration of one hour. This test also was used to measure extreme pressure failure loads of the new compositions. In this test friction coefficients are measured by applying a load of 150N and increasing it 100N per experiment until a rapid rise in the friction coefficient is observed. The highest load achieved before a rapid rise is observed is called the Extreme Pressure Limit. This data demonstrates that the frictional characteristics, or coefficient of friction, as well as the load carrying capabilities and extreme pressure failure limits of representative fluids of the present invention are equal to premium commercial fluids currently in service. In Table 4, Formulation "A" represents a fluid with a viscosity close to the ISO 32 criteria. Formulation "B" is representative of the present invention as an ISO 68 formulation.

TABLE 4

| Frictional Coefficients of Representative Fluids | | | | |
|---|---|---|---|---|
| Conditions: | Example A | Example B | Sullube | Ultra Coolant |
| Basestock Composition | | | | |
| Carbowax 300 (wt %) | 89 | 69 | | |
| SYNALOX 40-D100 (wt %) | 10 | 30 | | |
| Total Additives (wt %) | 1 | 1 | | |
| Average Dynamic Coefficient of Friction | | | | |
| 100N Loading 60° C. | 0.068 | 0.067 | 0.065 | 0.071 |
| 200N Loading 20° C. | 0.106 | 0.106 | 0.119 | 0.122 |
| Extreme Pressure Limit, (Newtons, N) | | | | |
| 20° C. | 150 | 150 | 150 | 150 |
| 60° C. | 150 | 150 | 150 | 150 |

This data demonstrates that the lubricant compositions of the present invention are at least as effective from a standpoint of lubricity and coefficient of friction as commonly used commercial products currently available.

The non-aqueous water soluble compositions of the present invention are particularly useful in food processing and packaging equipment applications where low viscosity food grade lubricants with low pour points are desired, and in applications where there is a need for water cleaning of equipment and spill cleanup.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. Non-aqueous water soluble food grade lubricant compositions consisting essentially of:

(a) 15 percent by weight to 50 percent by weight of a polyalkylene glycol monol or diol, comprised of an ethylene oxide/propylene oxide copolymer, having a molecular weight greater than 1,500 up to 3000; and (b) 50 percent by weight to 85 percent by weight of a polyethylene glycol having molecular weight of from 200 to 600;

wherein said lubricating compositions have a viscosity of 28 to 100 cSt at 40° C.

2. The non-aqueous water soluble food grade lubricant composition of claim 1, wherein the polyalkylene glycol monol or diol is an [alpha]-Butyl-omega-hydroxypoly(oxyethylene)poly(oxypropylene)polymer.

3. The non-aqueous water soluble food grade lubricant compositions according to claim 1, wherein said lubricating compositions have a viscosity of 32 to 68 cSt at 40° C.

4. The non-aqueous water soluble food grade lubricant compositions according to claim 1, wherein the polyethylene glycol, component (b), has a molecular weight from 200 to 400.

5. The non-aqueous water soluble food grade lubricant compositions according to claim 1, wherein the polyethylene glycol, component (b), has a molecular weight from 200 to 300.

6. The non-aqueous water soluble food grade lubricant compositions according to claim 1, further comprising at least one functional food grade additive.

7. The non-aqueous water soluble food grade lubricant compositions according to claim 6 wherein at least one functional food grade additive is selected from the group consisting of a food grade lubricity additive, a food grade corrosion inhibitor, a food grade metal passivator, a food grade antioxidant, and a food grade anti-foam agent.

8. The non-aqueous water soluble food grade lubricant compositions according to claim 7 wherein the food grade antioxidant is an amine containing antioxidant.

9. The non-aqueous water soluble food grade lubricant compositions according to claim 7 wherein the food grade corrosion inhibitor is a liquid mixture of amine phosphates.

10. The non-aqueous water soluble food grade lubricant compositions according to claim 7 wherein the food grade metal passivator is a tolytriazole derivative.

11. A method of lubricating surfaces and interior parts of the machinery used for processing or packaging food which method comprises the step of applying to the surfaces of the food processing or packaging machinery, or circulating through the machinery, non-aqueous water soluble food grade lubricant compositions consisting essentially of:

(a) 5 percent by weight to about 50 percent by weight of a polyalkylene glycol comprised of an ethylene oxide/propylene oxide copolymer, having a molecular weight greater than 1,500 up to 3000; and (b) 50 percent by weight to about 85 percent by weight of a polyethylene glycol having molecular weight of from 200 to 600;

wherein said lubricating compositions have a viscosity of about 28 to about 100 cSt at 40° C.

12. The method of lubricating according to claim 11, wherein the polyalkylene glycol is an [alpha]-Hydro-omega-hydroxypoly(oxyethylene)poly(oxypropylene) polymer.

13. The method of lubricating according to claim 11, wherein the polyalkylene glycol is an [alpha]-Butyl-omega-hydroxypoly(oxyethylene) poly(oxypropylene) polymer.

14. The method of lubricating according to claim 11, wherein said lubricating compositions have viscosities of 32 to 68 cSt at 40° C.

15. The method of lubricating surfaces and interior parts of the machinery used for processing or packaging food according to claim 11, wherein the polyethylene glycol, component (b), has molecular weight from about 200 to about 400.

16. The method of lubricating surfaces and interior parts of the machinery used for processing or packaging food according to claim 11, wherein the polyalkylene glycol, component (a) is present in an amount of from 15 to 50 percent by weight, based on the total weight of the lubricant composition.

17. A method of lubricating surfaces of the machinery used for processing or packaging food according to any one of claims 11-16 wherein the lubricant compositions further comprise at least one functional food grade additive.

* * * * *